US006634432B2

(12) United States Patent
Sundholm

(10) Patent No.: US 6,634,432 B2
(45) Date of Patent: Oct. 21, 2003

(54) FIRE FIGHTING INSTALLATION INCLUDING A CONSTANT POWER PUMP UNIT

(75) Inventor: Goran Sundholm, Tuusula (FI)

(73) Assignee: Marioff Corporation Oy

( * ) Notice: Subject to any disclaimer, the term of this patent is extended or adjusted under 35 U.S.C. 154(b) by 0 days.

(21) Appl. No.: 10/103,981

(22) Filed: Mar. 22, 2002

(65) Prior Publication Data

US 2002/0117311 A1 Aug. 29, 2002

Related U.S. Application Data

(63) Continuation of application No. 09/535,385, filed on Mar. 24, 2000, now abandoned.

(30) Foreign Application Priority Data

Nov. 2, 1999 (FI) ..... 992366

(51) Int. Cl.[7] ..... A62C 35/00

(52) U.S. Cl. ..... 169/16; 169/13; 169/54; 169/61; 169/62

(58) Field of Search ..... 169/5, 13, 16, 169/54, 57, 60, 61, 62; 417/2–7, 44.1, 44.2, 44.4, 326, 374

(56) References Cited

U.S. PATENT DOCUMENTS

| | | | |
|---|---|---|---|
| 3,703,930 | A | 11/1972 | Lofstrand et al. |
| 4,351,394 | A | 9/1982 | Enk |
| 5,040,611 | A | 8/1991 | Steel |
| 5,072,792 | A | 12/1991 | Simons et al. |
| 5,531,275 | A | 7/1996 | Sundholm |

FOREIGN PATENT DOCUMENTS

| | | |
|---|---|---|
| EP | 1010441 | 12/1999 |
| FR | 2769508 | 4/1999 |
| GB | 2215204 | 9/1989 |
| JP | 10192440 | 7/1998 |
| JP | 10248951 | 9/1998 |
| WO | 9425113 | 11/1994 |

OTHER PUBLICATIONS

Patent Abstract of Japan of JP 10192440 dated Jul. 28, 1998.

Patent Abstract of Japan of JP 10248951 dated Sep. 22, 1998.

English Abstract of FR 2769508 dated Apr. 6, 1999.

*Primary Examiner*—Steven J. Ganey
(74) *Attorney, Agent, or Firm*—Ladas & Parry

(57) ABSTRACT

The invention relates to an installation for extinguishing fire in a unit, preferably a train with at least one railway carriage, or a tunnel, the installation comprising several spray heads (3) whereof a number that is smaller than the total number of spray heads can be activated according to the location of the fire in the unit, and a drive source (5) for delivering extinguishing medium through a pipe system (4) to the activated spray heads. In order to provide a powerful and increased delivery of extinguishing medium from the active spray heads in such a case that only some of the spray heads in the installation are released, the installation is characterized by the drive source comprising a pump unit including a pump (50) in order to provide a pumping pressure for pumping extinguishing medium into the activated spray head/heads, the pump unit comprising a control unit (52, 53) arranged to increase the extinguish medium flow of the pump unit when the number of releasing spray heads increases in such a way that the effect of the pump unit is at least mainly kept constant.

17 Claims, 5 Drawing Sheets

1
2
3
4
5
50
51
52
53
54
M
P
I
Pressure transducer
Pumper Wagon
Water tank
Filter

FIRE FIGHTING INSTALLATION INCLUDING A CONSTANT POWER PUMP UNIT

This is a continuation of Ser. No. 09/535,385 filed Mar. 24, 2000, now abandoned.

BACKGROUND OF THE INVENTION

The invention relates to an installation for extinguishing fire in a unit, preferably a train with at least one railway carriage, or a tunnel, the installation comprising several spray heads, whereof a number that is smaller than the total number of spray heads can be activated according to the location of the fire in the unit, and a drive source for delivering extinguishing medium through a pipe system to the activated spray heads.

Known fire extinguishing installations are generally arranged to provide a particular mainly constant flow from every spray head or sprinkler, i.e. a spray head comprising a release means (typically an ampoule that explodes at high temperatures) irrespective of the number of spray heads and sprinklers in the fire extinguishing installation. A constant flow for each spray head thus applies, irrespective of the number of releasing spray heads in the installation. If the installation comprises a larger number of spray heads, these can be divided into fire zones in such a manner that only the zone where fire is detected is released. The flow of extinguishing medium for each spray head is constant regardless of the number of released fire zones.

In fire extinguishing installations the drive medium source that drives extinguishing medium to the spray heads has a particular effect that is assumed to provide a certain minimum flow for each spray head. If the installation comprises several spray heads, the effect of the drive medium source has to be high compared with an installation that includes a few spray heads only. This also applies if the installation has several fire zones.

Known fire extinguishing installations including several spray heads and possibly a number of fire zones are provided with a function and a construction meaning that only a part of the effect of the drive source is utilized in such a case that only a part of the spray heads (or fire zones) of the installation are released. The power available is therefore not utilized in the drive source of the fire extinguishing installation in case all the spray heads in the installation are not released.

It is commonly known that fire extinguishing must be started as efficiently as possible. This means that a particularly efficient extinguishing medium spray should initially be discharged which is able to extinguish the fire at an early stage, before the fire spreads.

BRIEF DESCRIPTION OF THE INVENTION

It is an object of the present invention to efficiently extinguish fire by providing an installation which comprises several spray heads and which initially provides a maximum flow in the releasing spray heads, when only a part of the spray heads thereof are released.

For this object the present invention provides an installation for extinguishing fire in a unit, preferably a train with at least one railway carriage, or a tunnel, the installation comprising several spray heads, whereof a number that is smaller than the total number of spray heads can be activated according to the location of the fire in the unit, and a drive source for delivering extinguishing medium through a pipe system to the activated spray heads, wherein the drive source comprises a pump unit including a pump in order to provide a pumping pressure for pumping extinguishing medium into the activated spray head/heads, the pump unit comprising a control unit arranged to increase the extinguishing medium flow of the pump unit when the number of releasing spray heads increases in such a way that the effect of the pump unit is at least mainly kept constant. Here the term "effect" refers to the working or instantaneous power.

According to a particularly preferable embodiment of the invention the spray heads are placed in the unit in a number of fire zones, which are activated separately or in groups, comprising a number of spray heads for each fire zone, and the installation comprises a number of detectors for activating the fire zones, the detectors being arranged to start delivering extinguishing medium to the respective fire zone when detecting fire, the pump unit being arranged to increase the extinguishing medium flow when the number of activated fire zones and the number of releasing spray heads increase.

The pump unit preferably comprises 2 to 10 pumps whereof a minimum number is arranged to be coupled in operation depending on the number of activated spray heads, whereby the control unit comprises a gear box for coupling the minimum number of pumps in operation. A similar pump unit preferably includes a diesel motor operating with an optimal constant number of revolutions (rpm).

The installation is particularly suitable for extinguishing fire in trains and in tunnels and the like, where a fire extinguishing installation must typically be divided into a number of fire sections.

The main advantage of the fire extinguishing installation is to enable a powerful and increased delivery of extinguishing medium from the active spray heads in such a case that only some spray heads in the installation are released. The larger the number of non-releasing spray heads, the more powerful delivery of extinguishing medium is allowed from every releasing, or active, spray head, and the releasing spray heads are therefore able to fight fire efficiently. The fire can thus be rapidly extinguished using as few as possible of the activated fire zones and using a relatively small amount of extinguishing medium, and the risk of the fire spreading is thus small. In practice it is most likely that only one fire zone or two at the most is activated.

BRIEF DESCRIPTION OF THE DRAWINGS

In the following the invention will be described in greater detail by means of three embodiments with reference to the accompanying drawing, in which.

DETAILED DESCRIPTION OF THE INVENTION

Figure 1:
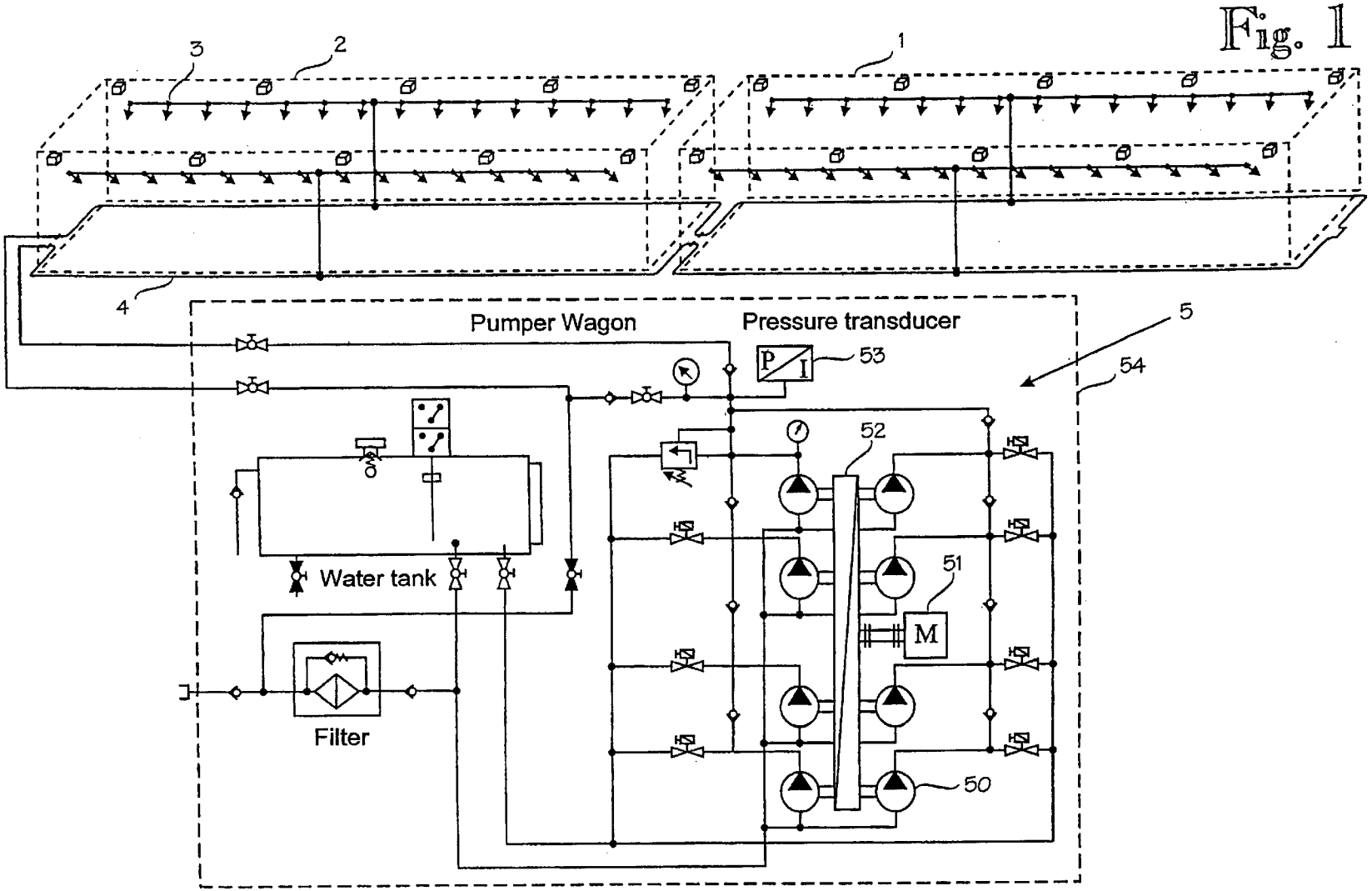
FIG. 1 shows a fire extinguishing installation applied to a train.

FIG. 1 shows two railway carriages 1, 2 of a train with several railway carriages including a fire extinguishing installation comprising several sprinklers, i.e. spray heads 3 with release means reacting on heat and mounted along and close to the side walls of the railway carriages. A pipe system 4 is arranged to deliver extinguishing medium in the form of water-based liquid from a drive source or a drive unit 5 to the spray heads 3.

The drive source 5 comprises a pump unit including eight high pressure pumps 50 and an engine 51, for example a diesel engine having a power of 270 kW operating the high pressure pumps, and a control unit 52, 53 that controls the flow and pressure of the pump unit. The drive unit can be arranged in a railway carriage 54.

Figure 2:
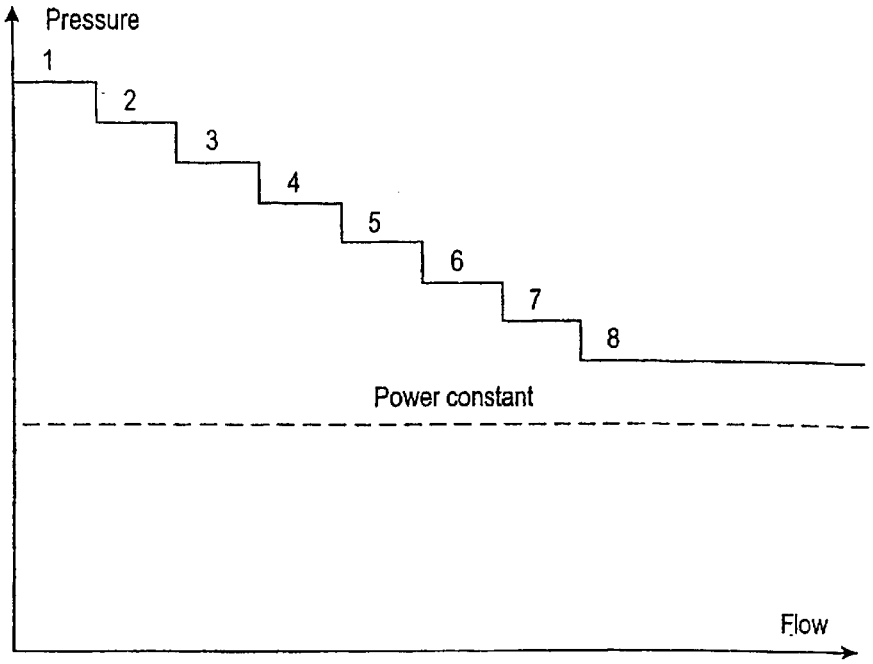
FIG. 2 shows how pressure is changed with the flow in FIG. 1.

The spray heads are arranged to be released after the heat-sensitive release means thereof explode or melt at high temperatures. A pressure transducer 53 measures the pressure in the pipe system 4 and starts the engine 51 of the pump unit after releasing one of the spray heads 3. Depending on the number of releasing spray heads, a different number of pumps 50 is coupled in operation through a gear box 52. The engine 51 operates with constant effect (power). If only one pump 50 is coupled in operation, the pressure in the released spray head/heads becomes very high, for example 160 bar. On account of the high pressure the released spray if head/heads spray powerfully; the effect of the engine 51, typically the highest possible effect or power of the engine, is fully employed even if only some of the spray heads are released. If two or more pumps 50 are coupled in operation, as a result of the fact that several spray heads are released, the pressure in the individual spray heads decreases but the total flow increases. On account of the arrangement different maximum nozzle pressures and maximum flows can be achieved when fighting fire. FIG. 2 illustrates how the pressure changes as a function of the total flow in the spray heads of the installation.

Figure 3:
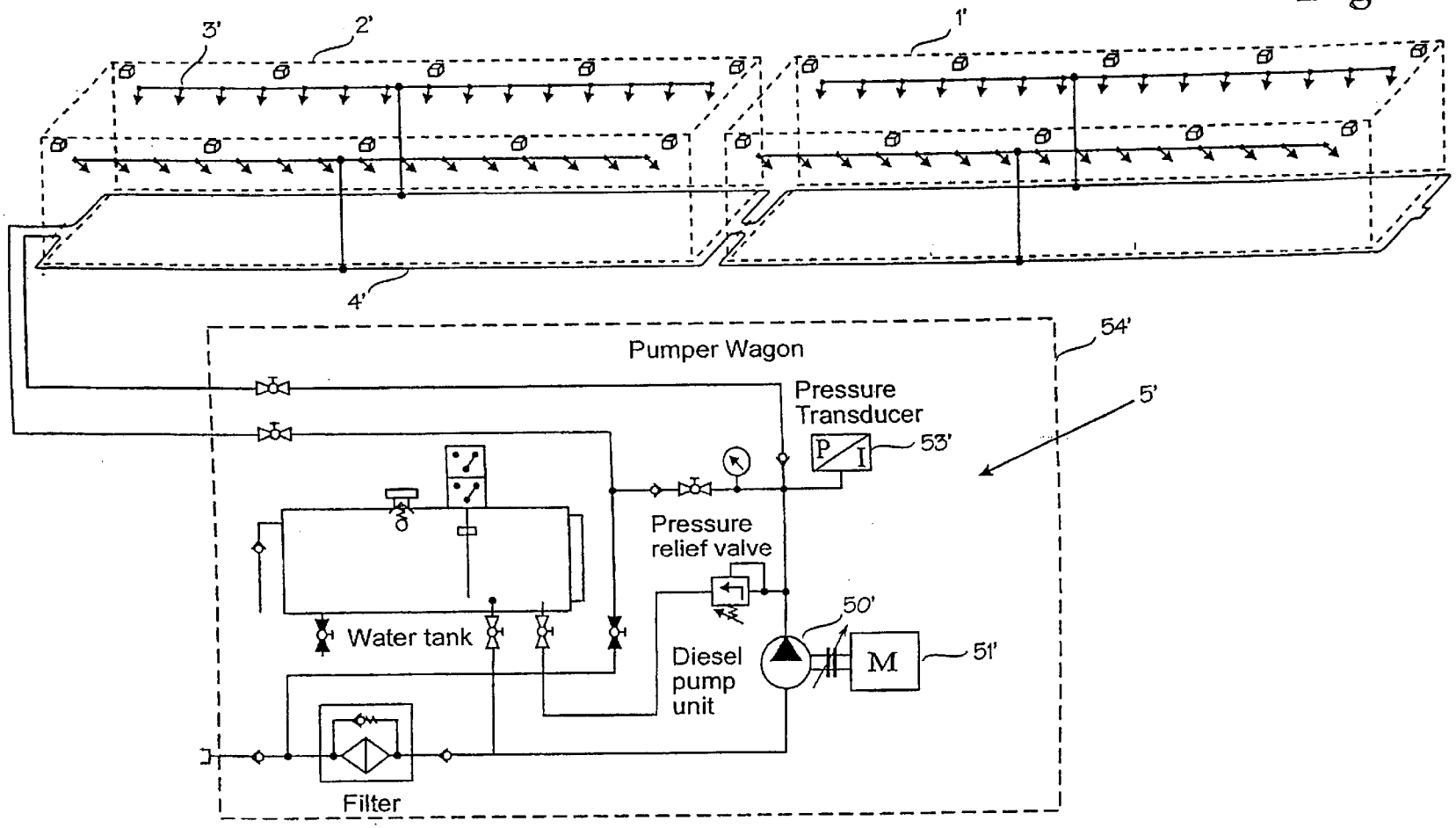
FIG. 3 shows a second embodiment of the fire extinguishing installation applied to a train.

FIG. 3 shows a second preferred embodiment of the invention. The same analogue reference numerals are used as in FIG. 1 for corresponding components. The installation in FIG. 3 differs from the one in FIG. 1 in that the drive unit 5' comprises a control unit including a pressure transducer 53'. The control unit is arranged to adjust the number of revolutions in the diesel engine 51' in order to provide a maximum effect from the pump unit. The control unit 53' adjusting the number of revolutions in the diesel engine is not described in this context, as such a control unit can easily be accomplished by those skilled in the art. The control unit 53' is preferably arranged to measure the pressure or the pressure changes in the pipe system 4' and thereafter to control the number of revolutions in the diesel engine so that number of revolutions multiplied by the pressure is constant, thus providing an approximately constant effect. The maximum number of revolutions and the maximum pressure are both limited.

Figure 4:
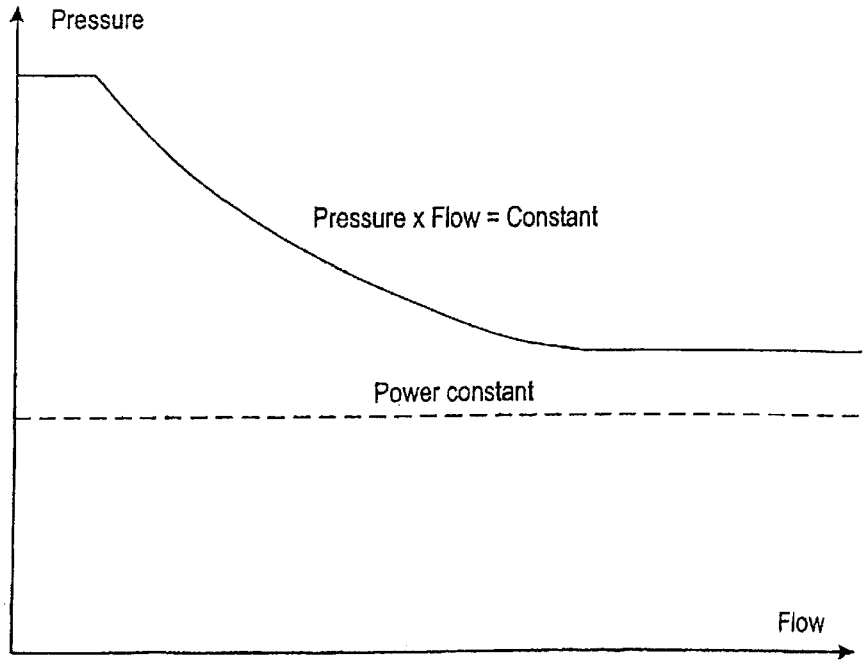
FIG. 4 shows how pressure changes with the flow in FIG. 3.

FIG. 4 shows how the pressure changes as a function of the total flow.

Figure 5:
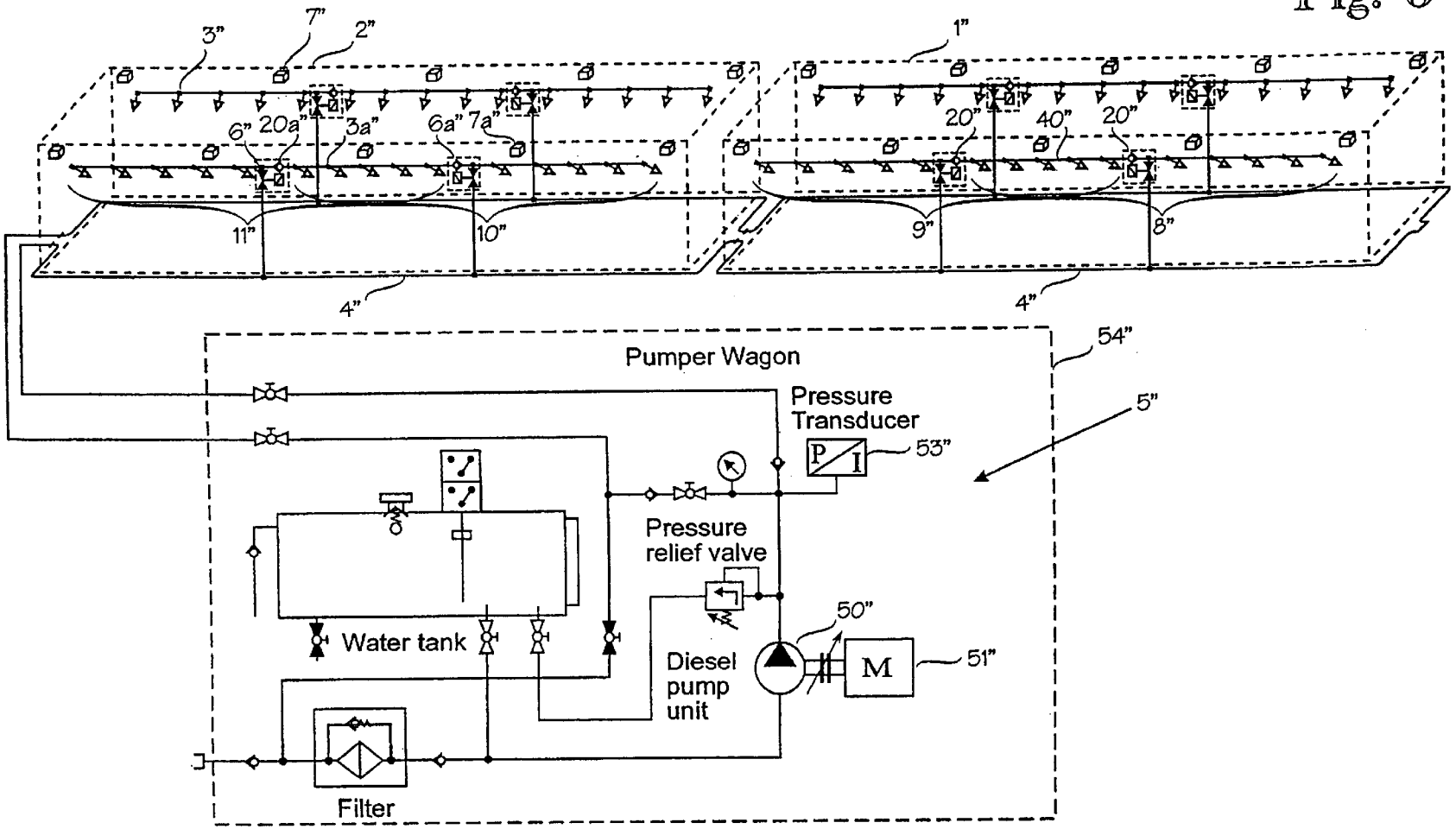
FIG. 5 shows a third embodiment of the fire extinguishing installation applied to a train.

FIG. 5 shows a third embodiment of the invention. Here the same analogue reference numerals are used as in FIG. 1 for corresponding components. The fire extinguishing installation corresponds with the one in FIG. 3 except that the spray heads of the railway carriages 1", 2" are divided into fire zones 8"–11", and the spray heads 3" are of such a type that they lack release means that can be activated by heat.

The spray heads 3" are arranged in fire zones 8"–11", both comprising a respective sectional valve 6", **6*a*". Detectors 7" reacting for example on radiation or smoke, or an optical detector, are arranged to control the respective sectional valves 6" so that these are opened when fire is detected: detector 7*a*", for example, controls sectional valve 6*a*"** only.

In case of fire, extinguishing medium flows through a sectional valve 6" and a distribution pipe 40" to the fire zone in which fire is detected. Check valves 20" are arranged in the distribution pipe 40". The check valves 20" prevent the spray heads in the fire zone close by and on the same side of the railway carriage to be released if the detector thereof has not provided a signal.

Figure 6:
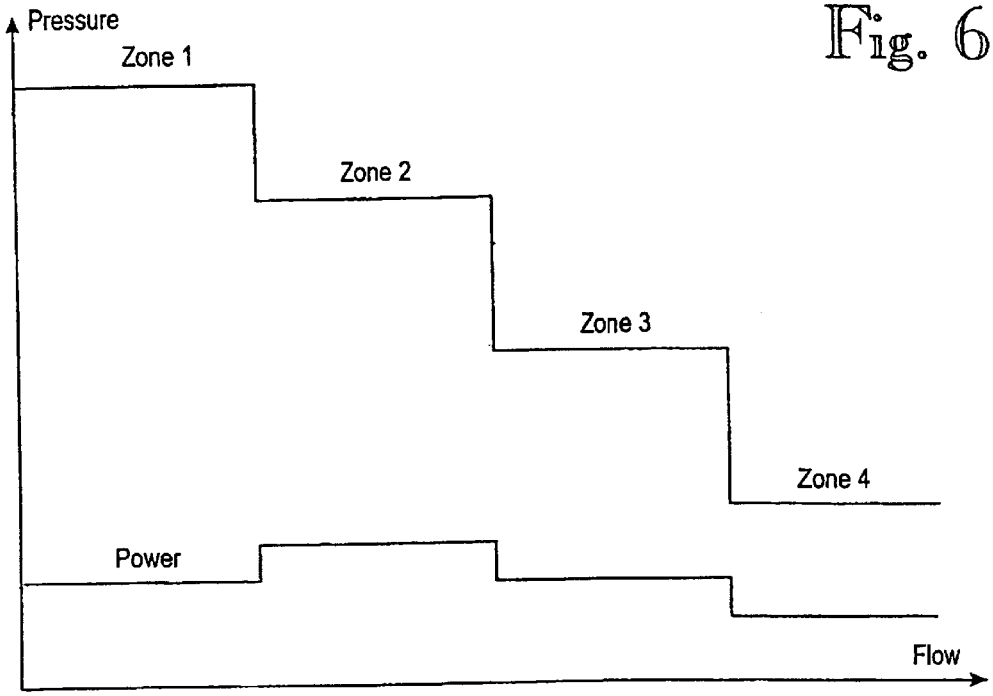
FIG. 6 shows how pressure changes with the flow in FIG. 5.

The installation thus operates in such a manner that a detector **7*a*", for example, provides a signal, and as a result the sectional valve 6*a*" is opened, the pump unit 50", 51" is started and extinguishing medium is delivered to the spray heads 3*a*" which are placed on the right of the check valve 20*a*". The pump unit operates with an effect that is at least mainly constant and corresponds to the maximum effect of the pump unit despite the number of activated fire zones, i.e. in spite of e.g. the fire zone 11" also being activated, c.f. FIGS. 5 and 6**.

An example on the influence of a control unit adjusting the number of revolutions in the diesel engine: in case only the fire zone 8" and a corresponding fire zone on the opposite side of the railway carriage (Zone 1 in FIG. 5) is activated and the K factor of the spray heads 3" is 3,20, the nozzle pressure in the twenty activated spray heads is 141 bar, the total flow in the activated spray heads is 761 l/min, the maximum pressure in the pump will obtain the value 177 bar (i.e. a pressure drop of 30 bar in the pipe system and the actual distribution pipes) and the effect of the pipe unit is 270 kW. If several fire zones are activated, the nozzle pressure is lower, the total flow is higher, and the maximum pressure in the pump unit remains lower (the pressure drop in the pipe system is also higher) and the effect of the pump unit is 270 kW.

Instead of a control unit that is arranged to increase the number of revolutions in the diesel engine if more than one fire zones are activated, a pump unit can be employed including several pumps and a gear box, as shown in FIG. 1.

It is an advantage with the control unit in FIG. 1 compared with a control unit controlling the number of revolutions in the diesel engine that the total flow within a larger interval can be varied without changing the effect of the pump unit. This is due to the fact that when the number of revolutions is adjusted, the diesel engines are not able to provide a maximum effect when the number of revolutions is small, which is associated with the characteristics of a diesel engine.

Figure 7:
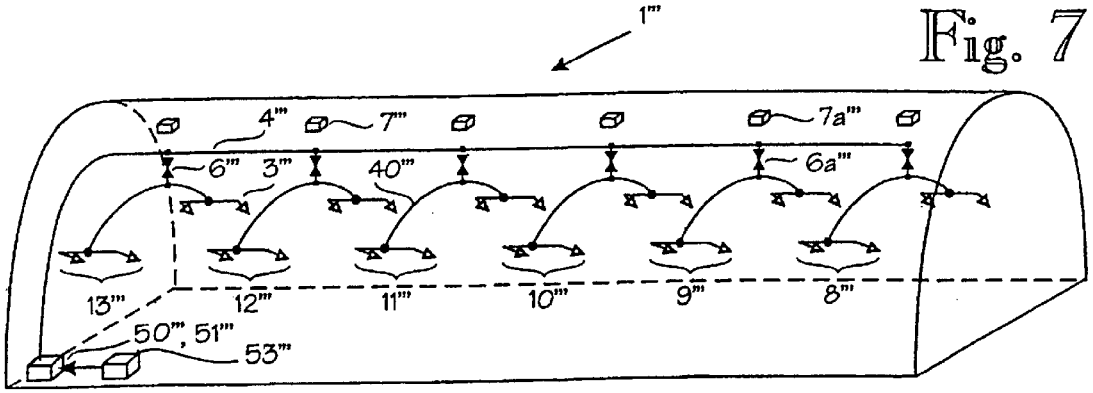
FIG. 7 shows a fire extinguishing installation applied to a tunnel.

FIG. 7 illustrates an installation of the invention mounted in a vehicle tunnel 1'", for example, a train or car tunnel. The same analogue reference numerals are used here as in FIGS. 1 and 2 for corresponding components. The tunnel 1'" is divided into six fire zones 8'"–13'" comprising four spray heads 3'" each. Each fire zone comprises a sectional valve 6'" respectively. It is obvious that a long tunnel should comprise hundreds, even thousands, of spray heads and many more fire sections and detectors 7'" than what is shown in FIG. 7 in order to fight fire along the entire tunnel. Some of the sectional valves 6'" can be left out in case the distribution pipes 40'" in the fire zones following one another are connected and check valves are mounted in the same way as the distribution pipes in FIG. 5.

The installation in FIG. 7 operates in such a manner that if, for example, the fire detector **7*a*" provides a signal, the corresponding sectional valve 6a'" is opened, and the spray heads in the fire zone 9'" start to spray extinguishing medium. The pressure becomes very high compared with a situation where several zones, for example the fire zones 8'''–10''', are activated. Regardless of the number activated fire zones, the effect of the pump unit 50''', 51''' is set at a constant maximum value, as described above by means of the control unit 53'''** which is of the type that adjusts the number of revolutions in the power source, for example, the diesel engine. An engine operating with a constant number of revolution in order to operate a number of pumps through a gear box can alternatively be used.

The installation in FIGS. 1, 3, 5 and 7 can preferably be used periodically with reduced effect during a fire extinguishing process. This holds true particularly in applications where the amount of water is limited to a minimum and a particular protection time is desired so that fire fighters have time to arrive and take control of the fire. The capacity of the pump unit of the installation is then adjusted so that the pump unit flow and the installation pressure are reduced to a particular level after radiation heat from the fire is reduced to a certain level. If fire starts again and generates more heat, the pump unit flow and pressure are increased. The adjustment of the pumping effect can be implemented by means of connecting a number of pumps or by controlling the number of revolutions in the engine, as described above.

The invention has in the above been described with reference to four examples only, and it is therefore pointed out that the details of the invention may vary in many ways within the scope of the appended claims. For example, the number of fire zones and spray heads can vary. The installation may comprise combinations of said spray heads with and without release means that can be activated by heat. The number of pumps 50 can preferably vary between 2 to 10. The drive source for driving the pump/pumps does not have to be a diesel engine, but may also be a frequency or a thyristor-controlled electric engine.

I claim:

1. In an installation for extinguishing fire in a unit, the improvements comprising:

a total number of spray heads (3, 3', 3", 3''') whereof a number that is smaller than the total number of spray heads can be activated spray head/heads according to a location of the fire in the unit, and a drive source (5, 5', 5", 5''') for delivering a flow of extinguishing medium through a pipe system (4, 4', 4", 4''') to the activated spray head/heads, wherein the drive source comprises a pump unit including a pump or pumps (50, 50', 50", 50''') and an engine (51, 51', 51", 51''') in order to provide by an effect of the pump unit a pumping pressure for pumping extinguishing medium into the activated spray head/heads, and a control unit (52, 53, 53', 53", 53''') arranged to increase the extinguishing medium flow of the pump unit when the number of the activated spray head/heads increases in such a way that the effect of the pump unit is at least mainly kept constant.

2. An installation as claimed in claim 1, wherein the total number of spray heads (3", 3''') are placed in the unit in a number of fire zones (8"–11", 8'''–13'''), which fire zones are activated separately or in groups, and the installation comprises a number of detectors (7", 7''')for activating the fire zones (8"–11", 8'''–13'''), the detectors being arranged to start delivering extinguishing medium to the respective fire zone when detecting fire, the pump unit being arranged to increase the extinguishing medium flow when the number of activated fire zones and the number of activated spray heads increase.

3. An installation as claimed in claim 2, in which the unit is an elongated unit (1, 2, 1', 2', 1", 2", 1''') with longitudinal side walls, wherein the fire zones (8"–11", 8'''–13''') and the total number of spray heads (3", 3''') are consecutively arranged along the elongated unit (1, 2, 1', 2', 1", 2", 1''').

4. An installation as claimed in claim 3, wherein the fire zones (8"–11", 8'''–13''') extend along the longitudinal side walls of the elongated unit (1, 2, 1', 2', 1", 2", 1''') in such a manner that both side walls comprise substantially the same number of fire zones.

5. An installation as claimed in claim 4, wherein the detectors (7", 7''') are arranged to control sectional valves (6", 6''') arranged between the pipe system (4", 4''') and distribution pipes (40", 4''') leading towards the fire zones (8"–11", 8'''–13'''), the sectional valves being arranged to be opened when the respective detectors provide a signal for delivering extinguishing medium to the respective fire zones.

6. An installation as claimed in claim 3, wherein the detectors (7", 7''') are arranged to control sectional valves (6", 6''') arranged between the pipe system (4", 4''') and distribution pipes (40", 40''') leading towards the fire zones (8"–11", 8'''–13'''), the sectional valves being arranged to be opened when the respective detectors provide a signal for delivering extinguishing medium to the respective fire zones.

7. An installation as claimed in claim 6, wherein check valves (20") are arranged in connection with the distribution pipes (40"), the check valves allowing the extinguishing medium to flow through the sectional valves (6") to the spray heads in the respective fire zone but preventing the extinguishing medium to flow through said sectional valves to an adjacent fire zone.

8. An installation as claimed in claim 7, wherein some of the consecutive and adjacent fire zones (8", 9" and 10", 11") comprise spray heads which are common for these fire zones and which are arranged to spray extinguishing medium when activating either of said fire zones.

9. An installation as claimed in claim 3, wherein the elongated unit is a railway carriage (1, 2, 1', 2', 1", 2").

10. An installation as claimed in claim 3, wherein the elongated unit is a tunnel (1''').

11. An installation as claimed in claim 1, wherein the pump or the pumps are high pressure pumps.

12. An installation as claimed in claim 11, wherein the pump unit comprises 2–10 of the pumps (50) whereof a minimum number of the 2–10 pumps is arranged to be coupled in operation depending on the number of activated spray heads (3).

13. An installation as claimed in claim 12, wherein the control unit comprises a gear box (52) for coupling the minimum number of the 2–10 pumps (50) in operation.

14. In an installation for extinguishing a fire in a unit, the improvements comprising:

a total number of spray heads (3, 3', 3", 3''') wherein one or more of the spray heads less than the total number of spray heads are activated according to a location of the fire in the unit; and a drive source (5, 5', 5", 5''') for delivering a flow of extinguishing medium through a pipe system (4, 4', 4", 4''') to the activated one or more less than the total number of spray heads, wherein the drive source comprises a pump unit including a pump (50, 50', 50", 50''') and an engine (51, 51', 51", 51''') in order to provide by an effect of the pump unit a pumping pressure for the flow of the extinguishing medium into the activated one or more less than the total number of spray heads, and a control unit (52, 53, 53', 53", 53''') arranged to increase the number of revolutions of the engine when the number of the activated one or more less than the total number of the spray heads increases, in response to a decrease in the pumping pressure submitted to the activated spray heads in such a way that the effect of the pump unit is at least mainly kept constant.

15. In an installation for extinguishing a fire in at least one carriage of a railway train or a tunnel, the improvements comprising:

a total number of spray heads (3, 3', 3", 3'") in the at least one carriage of a railway train or a tunnel, wherein one or more of the spray heads less than the total number of spray heads are activated according to the location of the fire in the at least one carriage of a railway train or a tunnel; and a drive source (5, 5', 5", 5'") for delivering a flow of extinguishing medium through a pipe system (4, 4', 4", 4'") to the activated one or more less than the total number of spray heads, wherein the drive source comprises a pump unit including a pump (50, 50', 50", 50'") and an engine (51, 51', 51", 51'") in order to provide by an effect of the pump unit a pumping pressure for the flow of the extinguishing medium into the activated one or more less than the total number of spray heads, and a control unit (52, 53, 53', 53", 53'") arranged to increase the number of revolutions of the engine when the number of the activated one or more less than the total number of the spray heads increases, in response to a decrease in the pumping pressure submitted to the activated spray heads, in such a way that the effect of the pump unit is at least mainly kept constant.

16. In an installation for extinguishing fire in a unit, the improvements comprising:

a total number of spray heads (3, 3', 3", 3'") whereof a number that is smaller than the total number of spray heads can be activated spray head/heads according to a location of the fire in the unit, and a drive source (5, 5', 5", 5'") for delivering a flow of extinguishing medium through a pipe system (4, 4', 4", 4'") to the activated spray head/heads, wherein the drive source comprises a pump unit including a pump (50, 50', 50", 50'") and an engine (51, 51', 51", 51'") in order to provide by an effect of the pump unit a pumping pressure for pumping extinguishing medium into the activated spray head/heads, and a control unit (52, 53, 53', 53", 53'") arranged to increase the number of revolutions of the engine when the number of the activated spray head/heads increases, in response to a decrease in the pumping pressure submitted to the activated spray head/heads, in such a way that the effect of the pump unit is at least mainly kept constant.

17. In an installation for extinguishing a fire in at least one carriage of a railway train or a tunnel, the improvements comprising:

a total number of spray heads (3, 3', 3", 3'") in the at least one carriage of a railway train or a tunnel, wherein one or more of the spray heads less than the total number of spray heads are activated according to the location of the fire in the at least one carriage of a railway train or a tunnel; and a drive source (5, 5', 5", 5'") for delivering a flow of extinguishing medium through a pipe system (4, 4', 4", 4'") to the activated one or more less than the total number of spray heads, wherein the drive source comprises a pump unit including a pump (50, 50', 50", 50'") and an engine (51, 51', 51", 51'") in order to provide by an effect of the pump unit a pumping pressure for the flow of the extinguishing medium into the activated one or more less than the total number of spray heads, and a control unit (52, 53, 53', 53", 53'") arranged to increase the flow of the extinguishing medium when the number of the activated one or more less than the total number of the spray heads increases in such a way that the effect of the pump unit is at least mainly kept constant.

* * * * *